4-46
/10/86 CR 4,593,876

United States Patent [19]

Greiner

[11] Patent Number: 4,593,876

[45] Date of Patent: Jun. 10, 1986

[54] PICTURE STAND FOR SEVERAL PICTURES

[76] Inventor: Odin Greiner, Stettbacher Tal 13, D-6104 Seeheim-Jugenheim, Fed. Rep. of Germany

[21] Appl. No.: 668,072

[22] Filed: Nov. 5, 1984

[30] Foreign Application Priority Data

Nov. 9, 1983 [DE] Fed. Rep. of Germany ..... 3340418

[51] Int. Cl.[4] ..... A47G 1/14

[52] U.S. Cl. ..... 248/469; 40/10 D; 40/152

[58] Field of Search ..... 248/469, 475.1; 40/10 D, 152, 152.1, 489–491

[56] References Cited

U.S. PATENT DOCUMENTS

| | | | |
|---|---|---|---|
| 54,410 | 10/1866 | Hartell | 40/10 D |
| 2,295,468 | 9/1942 | Haley | 40/10 D |
| 3,364,603 | 1/1968 | Tate | 40/10 D |
| 3,561,146 | 2/1971 | Dembar | 40/10 D |
| 3,658,413 | 4/1972 | Cornell | 40/152 |
| 3,822,782 | 7/1974 | Ringle | 40/10 D |

*Primary Examiner*—Reinaldo P. Machado
*Assistant Examiner*—Alvin Chin-Shue
*Attorney, Agent, or Firm*—Michael J. Striker

[57] ABSTRACT

A picture stand for several pictures, which consists essentially of two prisms of equal length and size and whose section is a right-angled isosceles triangle. The prisms are located in a mount such that the two rectangular prism faces on a cathetus are mutually aligned and the two other rectangular prism faces on a cathetus are a small distance apart and pictures allocated to these prism faces are placed between them. Each of the plane rectangular prism faces on the hypotenuses also has a picture placed flat against it. The pictures are with their picture sides facing the prism faces.

This picture stand represents a new interesting possibility for holding four pictures of which only two are visible at a time depending on the direction of view. Compared with conventional picture stands for several pictures the space required is significantly reduced and apart from standing firmly, an interesting optical effect is achieved.

9 Claims, 5 Drawing Figures

PICTURE STAND FOR SEVERAL PICTURES

BACKGROUND OF THE INVENTION

The present invention relates to a picture stand for several pictures with a prismatic body of transparent material and a mount for the pictures having its front side adjacent to the surfaces of the prisms, said mount partially surrounding said prismatic body. A picture stand of this type is known from DE OS No. 2 252 743. This document describes a prismatic picture stand consisting essentially of transparent material with a picture holder, which can be slid onto the stand, covers at least two adjacent sides of the stand and preferably extends only a little over the edges of the free areas of the prism or cube. Though this stand is very stable, it occupies a relatively large space, particularly if it is intended to hold more than two pictures.

SUMMARY OF THE INVENTION

The purpose of this invention is to provide a picture stand which allows several pictures to be arranged in small space but nevertheless stands firmly. This problem is solved in a picture stand of the type mentioned above by the combination of technical features given in the characterising part of claim 1.

The picture stand according to the invention is characterized in that it provides a particularly convenient means of holding four pictures of which only two are visible at a time, depending on the direction of view. Thus it is possible to arrange four pictures in one picture stand in a suitable place, e.g. on a desk top, the stand being not higher and only slightly wider than the height and width respectively of a picture. The space required is reduced and in addition, an interesting optical effect is achieved.

Different versions of the invention are described in the subsidiary claims.

The invention is described below in greater detail with reference to the schematically simplified figures showing different versions. In these figures, corresponding parts have similar reference numbers and all details which do not contribute to the understanding of the invention have been omitted.

DESCRIPTION OF THE PREFERRED EMBODIMENTS

The picture stand shown in the figures has an optical system formed by the two prisms 1 and 2, which is held together by a mount 4 acting as a clamp and spring-loaded to press in the direction of the arrows 3 and possibly also a pedestal not shown in the FIGS. 1-5. Prisms 1 and 2 are of equal size and present a right-angled isosceles triangle in section; the acute complementary angle $\alpha$ and $\beta$ are both 45°. The side faces of each prism are rectangular and the faces on the hypotenuses 1A and 2A are correspondingly larger than the faces on the other two sides (cathetusses). Two pictures 5 are placed between the two parallel sides on cathetusses 1B and 2B, such that the front of each picture faces one of the two prism surfaces. The narrow space between prisms 1 and 2 in which the pictures 5 are located can be seen in FIGS. 1, 2 and 4.

Figure 3:
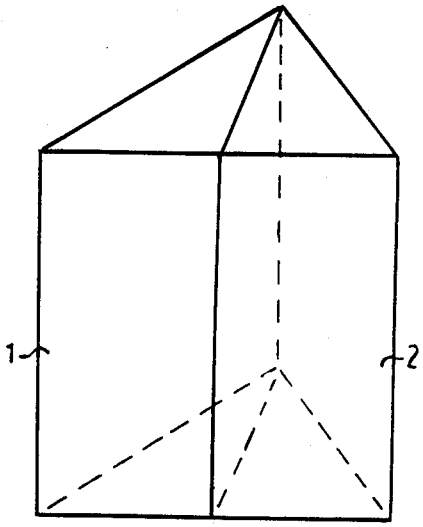
FIG. 3 is an isometric view of the two prisms forming the optical system.

In FIG. 3, which only shows the optical system consisting of prisms 1 and 2, the prisms 1 and 2 are in contact and no space for the pictures 5 is shown.

Figure 1:
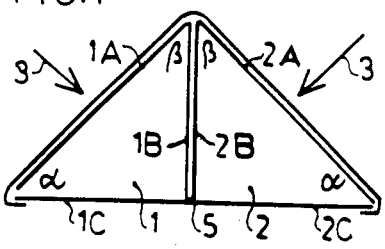
FIG. 1 is a plan view of a picture stand.
Figure 2:
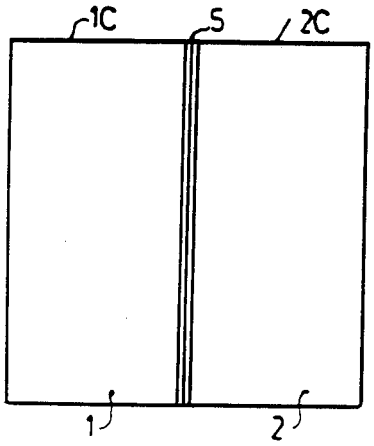
FIG. 2 is a front view of the picture stand shown in FIG. 1.
Figure 4:
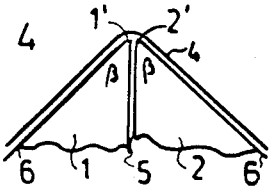
FIG. 4 is a plan view of the rear corner, as a constructive detail.

One picture 6 is located on each of the rectangular faces 1A and 2A on the hypotenuses, facing the prism surfaces in each case. These two pictures 6 are located between the prism surface and the mount 4, as indicated in FIGS. 1 and 4. The front faces of the two prisms on the other cathetusses 1C and 2C are mutually aligned. The height of the prismatic system shown in the figures, that is the length of the prisms, is at least 50% greater than the length of one cathetus 1C or 2C of these prisms are preferably about twice as great.

Figure 5:
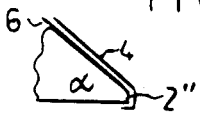
FIG. 5 is a plan view of one of the front side corners as a constructive detail.

It has been found advantageous to round or deburr the two edges furthest apart, each on an acute angle of the prisms 1 and 2 as shown in FIG. 4 and to round or deburr the two edges furthest apart, each on an acute angle as shown in FIG. 5, such that narrow, preferably rectangular surfaces 1', 2', 2'' are formed. It is further favourable if the pictures on the largest faces on the hypotenuses of the prisms 1 and 2 protrude sideways beyond the limits between the rectangular surface and the side area formed by breaking the long edges.

To change the pictures, the mount 4 is sprung open slightly in a direction opposite to that of the arrows 3 so that existing pictures can be removed and new pictures inserted.

Without further analysis, the foregoing will so fully reveal the gist of the present invention that others can, by applying current knowledge, readily adapt it for various applications without omitting features which fairly constitute essential characteristics of the generic and specific aspects of my contribution to the art.

What is claimed as new and desired to be protected by Letters Patent is set forth in the appended claims:

1. A picture stand for simultaneously holding a plurality of pictures, comprising two prisms of transparent material and having an equal size and being of the same rectangular triangular cross-section; and a mount holding said two prisms together, said prisms each having one side wall formed by one cathetus of a triangle and facing and parallel to and spaced from a respective side wall formed by one cathetus of the triangle of the other prism so as to form between the side walls facing each other a space accommodating at least one picture, each prism having a plane surface at the other cathetus thereof and forming a front side of the prism, said two prisms being held by said mount so that the front sides of both prisms are in alignment with each other, said mount overlapping a hypothenuse of each prism so as to form with a respective hypothenuse a space accommodating at least one picture.

2. Picture stand according to claim 1, wherein all walls of said prisms which are parallel to a longitudinal axis of the stand have rectangular shape.

3. Picture stand according to claim 1, wherein one of acute complementary angles ($\alpha$,$\beta$) of each triangle defining the cross-section of each prism is at least 40°.

4. Picture stand according to claim 1, wherein said mount is a clamping fixture which presses both prisms elastically together and which can be moved elastically against spring tension.

5. Picture stand according to claim 1, wherein said cross-section of each prism is of right-angled isosceles triangle.

6. Picture stand according to claim 1, wherein the height of each prism is at least 50% greater than one cathetus of each prism.

7. Picture stand according to claim 6, wherein in a vertical position upper and lower sides of each prism are perpendicular to longitudinal edges of the prisms, said sides being polished.

8. Picture stand according to claim 7, wherein both immediately adjacent longitudinal edges of both prisms are chamfered.

9. Picture stand according to claim 8, wherein most distant from each other longitudinal edges of both prisms are rounded off.

* * * * *